United States Patent [19]

Horodysky et al.

[11] Patent Number: 4,711,736

[45] Date of Patent: Dec. 8, 1987

[54] SULFURIZED OLEFINS AS ANTIWEAR/EXTREME PRESSURE ADDITIVES FOR LUBRICANTS AND FUELS AND COMPOSITIONS THEREOF

[75] Inventors: Andrew G. Horodysky, Cherry Hill; Derek A. Law, Pitman, both of N.J.

[73] Assignee: Mobil Oil Corporation, New York, N.Y.

[21] Appl. No.: 831,967

[22] Filed: Feb. 24, 1986

[51] Int. Cl.[4] ..... C10M 133/16; C10M 135/02

[52] U.S. Cl. ..... 252/47.5; 252/47; 252/51.5 A

[58] Field of Search ..... 252/47, 47.5

[56] References Cited

U.S. PATENT DOCUMENTS

| | | | |
|---|---|---|---|
| 2,337,473 | 12/1943 | Knowles | 252/45 |
| 2,793,999 | 5/1957 | Dietrich | 252/47.5 |
| 3,600,327 | 8/1971 | Hu | 252/47.5 |
| 3,664,955 | 5/1972 | Panzer | 252/47.5 |
| 4,089,792 | 5/1978 | Lowe | 252/47 |
| 4,119,549 | 10/1978 | Davis | 252/47 |
| 4,147,640 | 4/1979 | Jayne et al. | 252/45 |
| 4,191,659 | 3/1980 | Davis | 252/45 |
| 4,317,738 | 3/1982 | Spence | 252/47.5 |
| 4,344,854 | 8/1982 | Davis et al. | 252/47 |

*Primary Examiner*—William R. Dixon, Jr.
*Assistant Examiner*—Ellen M. McAvoy
*Attorney, Agent, or Firm*—Alexander j. McKillop; Michael G. Gilman; Howard M. Flournoy

[57] ABSTRACT

Reaction products of olefins, elemental sulfur, hydrogen sulfide, water and nitrogen-containing polymers provide multifunctional additives having antiwear/extreme pressure and thermal and oxidative stability characteristics for lubricants and fuels.

37 Claims, No Drawings

SULFURIZED OLEFINS AS ANTIWEAR/EXTREME PRESSURE ADDITIVES FOR LUBRICANTS AND FUELS AND COMPOSITIONS THEREOF

BACKGROUND OF THE INVENTION

This invention is directed to sulfurized products which are the reaction products of olefinically unsaturated compounds, sulfur, hydrogen sulfide, water and nitrogen-containing polymers useful as multifunctional additives to lubricant compositions, various greases and normally liquid hydrocarbyl or hydrocarbyloxy fuels. This invention is particularly directed to a process of preparing these sulfurized products, the products so prepared and lubricating and fuel compositions containing them.

Sulfurized olefins have been extensively used in many lubricant applications requiring extreme pressure/antiwear activity. These sulfurized olefins which include sulfurized $C_3$–$C_8$ olefins such as isobutylene, as described by A. G. Horodysky in U.S. Pat. Nos. 3,703,504; 3,703,505; and 3,873,454, generally employ methods of preparing their sulfurized products wherein the olefin is sulfohalogenated with a sulfur halide at some stage in their synthesis.

The direct sulfurization of olefins such as triisobutylene with sulfur is described, for example, in U.S. Pat. Nos. 2,995,569 and 3,796,661. U.S. Pat. No. 4,194,980 discloses cyclic sulfurized olefins prepared by reacting an olefin with a cyclic polydisulfide. U.S. Pat. Nos. 3,345,380 and 2,535,706 describe methods of making various thiones by reacting elemental sulfur and unsaturated hydrocarbons.

Sulfurized olefins have also been prepared by the direct sulfurization of olefins with sulfur and hydrogen sulfide, see U.S. Pat. Nos. 2,337,473; 4,119,549; 4,119,550; 4,191,659; 4,344,854 and 4,147,640.

U.S. Pat. No. 2,337,473 is directed to a process wherein sulfur, water, hydrogen sulfide and a hydrocarbon mixture containing unsaturated compounds are reacted. U.S. Pat. No. 3,664,955 discloses an additive mixture prepared by reacting elemental sulfur with long chain $C_{16}+$ unsaturated olefin monomers or polymers such as isobutylene and using same in conjunction with acid dispersants such as polyisobutenyl succinic anhydride condensed with tetraethylene pentamine.

U.S. Pat. Nos. 4,119,549 and 4,119,659 disclose the reaction of unsaturated compounds and a mixture of sulfur and hydrogen sulfide in the presence of a catalyst. Preferred catalysts include primary, secondary or tertiary alkyl amines.

Therefore it is well known that many methods have been used for producing organic sulfides by treating various olefinically unsaturated compounds. Furthermore, the use of amine-containing polymeric compounds such as succinimides has also been widely used in both fuels and lubricants as dispersants and detergent additives. Typically the prior art processes are expensive and difficult to control and frequently provide products having a highly disagreeable odor. To the best of applicants' knowledge the compositions disclosed herein have not previously been used as multifunctional friction reducing antiwear additives in lubricating oils, greases or fuel applications.

SUMMARY OF THE INVENTION

This invention relates to compositions comprising novel additive products which are synthesized by the co-reaction of five components under super atmospheric pressure and elevated temperature: (1) an olefinically unsaturated compound, (2) sulfur, (3) hydrogen sulfide, (4) water, and (5) an amine-containing polymer or other suitable polymeric material. As described hereinbelow these novel compositions of matter possess excellent antiwear/extreme pressure properties coupled with improved thermal and oxidative stability, improved odor properties and enhanced frictional properties and in both lubricant and fuel formulations. These unique sulfur and nitrogen-containing reaction products also possess a much desired lighter color not generally found in prior-disclosed sulfurized olefin or nitrogen-containing compositions.

The concept of co-reaction of olefins, water, sulfur and hydrogen sulfide can be extended to include polymeric esters, polymer ester/amides and/or borated derivatives thereof as a fifth co-reactant to form additional improved novel products. Included but not limited to are such as the following: carboxylic polymers as described in U.S. Pat. Nos. 3,163,603; 3,184,374; 3,215,707 or amine polymers such as those described in U.S. Pat. Nos. 3,413,347; 3,697,547; and 3,726,822, any of the above treated with boron compounds, carboxides, urea, etc., such as those in U.S. Pat. Nos. 3,702,757 and 3,708,522.

The exceptional benefits of this invention are also expected in a variety of hydrocarbon and/or alcohol-containing fuel compositions comprising synthetic and mineral oil applications.

This invention is therefore directed to a process of preparing sulfurized organic additive products to the additive products themselves and to compositions comprising oils of lubricating viscosity or greases prepared therefrom or normally liquid hydrocarbyl or hydrocarbyloxy fuels containing same.

DESCRIPTION OF SPECIFIC EMBODIMENTS

The invention in a particular aspect is directed to lubricant oil additives prepared readily and typically in a one step, one pot, economically favorable process can be implemented in a single high pressure reactor in order to form the novel, improved nitrogen-containing sulfurized olefinic additive products disclosed herein.

A wide variety of olefinic substances may be utilized in the process in accordance with the invention. This includes olefins with terminal or internal double bonds and containing from about 2 to 8 or more carbon atoms per molecule in either straight, branched chain or cyclic compounds and these may be exemplified by ethylene, propylene, 1-butene, cis and trans-2-butene, isobutylene, diisobutylene, triisobutylene, pentene, cyclopentene, hexene, cyclohexene, octene, 1-decene, etc. Also useful are diolefins of, for example butadiene, isoprene, divinyl benzene, pinene, p-methene and limonene. In general, $C_3$ to $C_6$ olefins or mixtures thereof are preferred and more preferably butylenes are desirable for preparing the sulfurized products embodied herein because the combined sulfur content of the product decreases with increasing carbon content and the miscibility of the product with oil is lower in the case of propylene and ethylene derivatives.

In some embodiments of the invention, therefore, isobutylene is particularly preferred as the predominant olefinic reactant, but it may be employed, desirably in major proportions, in mixtures containing one or more other olefins; moreover substantial proportions of saturated aliphatic hydrocarbons, as exemplified by methane, ethane, propane, butane, pentane, etc. may be contained in the olefinic feed. Such alkanes are preferably present in minor proportions in most instances to avoid unnecessary dilution of the reaction since they neither react nor remain in the product, but are expelled in the off-gases or by subsequent distillation. However, such mixed feed can substantially improve the economics of the process since such streams are of lower value than a stream of, for example, relatively pure isobutylene.

Volatile olefins are often readily available in liquid form, and it is usually desirable to utilize olefinic liquids which are vaporized by the heat of reaction, as such evaporation provides a substantial cooling effect that permits the flowing of water for cooling the reactor to be reduced considerably for greater economy. Also there are indications that the use of a volatile liquid olefin reactant has the unexpected and desirable effect of lowering the viscosity of the final product.

A suitable nitrogen-containing polymer is one having at least one free-amine group. Amine-containing polyalkenyl succinimides such as amine-containing polyisobutenyl succinimide are preferred. A typical amine-containing succinimide useful in this invention is the reaction product of a polyisobutenyl succinic anhydride (made by the co-reaction of polyisobutylene of 900 M.W. with maleic anhydride) with tetraethylene pentamine. Other similar amine-containing polymers can also be used in accordance with this disclosure. Other polymeric materials can also be used in this disclosure in place of the succinimides, including but not limited to polymeric esters, amides, imides and/or combinations thereof with succinimides.

The nitrogen-containing polymeric material accordingly may be selected from the group consisting of succinimides, amides, imides, esters containing nitrogen atoms, polyoxazoline and imidazoline compounds. Other preferred nitrogen-containing polymeric materials include the reaction products of polyalkenyl (polyisobutenyl) succinic anhydrides, and carboxylic acids, or dicarboxylic acids or their corresponding anhydrides with (a) polyethylene amines such as diethylenetriamine, triethylenetetramine, or the aforementioned tetraethylenepentamine;

(b) a mixture of polyols (such as pentaerythritol, trimethylol propane) and polyethylene amines or a mixture of such polyols and hydroxyl-containing amines.

(c) hydroxyl-containing amines such as tris(hydroxymethyl)aminomethane.

The molecular weight of the polymeric amine may vary from at least 500 to about 50,000, preferably 750–10,000 and more preferably 900–1,000 to about 5,000.

Polyoxazoline polymers are well known materials, e.g., poly (2-substituted-2-oxazoline) polymers are available from Dow Chemical Company. Poly(2-ethyl-2-oxazoline) designated PEOX 425 (Dow) is used in the examples which follow and has been found particularly useful.

The alkyl imidazoline compounds, also well known, can be prepared by reacting one mole of hydroxyethylethylene diamine with an appropriate organic acid, such as naphthenic or decanoic acid. Such a preparation is described in U.S. Pat. No. 4,440,658, which is incorporated herein by reference.

The nitrogen-containing polymeric material can also be selected from the group consisting of polymer ester-/amides and/or borated derivatives as the fourth co-reactant to form improved and novel products. Included are: "carboxylic dispersants" such as those described in U.S. Pat. Nos. 3,163,603, 3,184,374, 3,215,707, 3,316,177, 3,340,281, 3,341,547, 3,632,510, 3,632,511, 3,697,428, 3,725,441, or amine dispersants such as those described in U.S. Pat. Nos. 3,413,347, 3,697,574, 3,725,277, 3,725,480, 3,726,882 or any of above post-treated with boron compounds, epoxides, urea, etc., such as those in U.S. Pat. Nos. 3,702,757, 3,703,536, 3,704,308, and 3,708,522. The patents itemized in this paragraph are incorporated by reference. Omission of the above polymeric amines forms a product with higher objectionable odor level.

The reaction, preferably, is carried out by the direct reaction of the olefin, sulfur, hydrogen sulfide, water and nitrogen-containing polymer at temperatures from about 130° C. to 200° C. for periods of between 2 and 24 hours at pressures from atmospheric or preferably 300 up to about 900 psi. The preferred ratios between the reactants is between about 0.5 and 2 moles of olefin, 0.001 and 0.4 moles of nitrogen-containing polymer, and from about 0.4 to 0.8, or preferably from about 0.5 to about 0.7 or more preferably 0.6 moles of hydrogen sulfide to 1 mole of sulfur. The amount of free amine present should be that amount necessary to serve as a co-reactant and which improves product quality parameters such as odor, and optionally that amount useful to catalyze the reaction. Water must also be present as a co-reactant with concentration of from about 0.1% to about 70 wt. % and preferably from about 1% to about 50 wt. % or more particularly from about 2% to about 25 wt. % based upon the weight of olefin. After reaction is complete the product is vacuum topped, or nitrogen sparged and is then filtered to yield the desired reaction product composition. The reaction product thus obtained is believed to be a mixture of compounds, the mixture working to provide improved thermal and oxidative stability and improved friction reducing properties when added in effective amounts to a lubricant composition or hydrocarbon fuel. Ordinarily effective amounts will be in the range of 2 to 500 pounds per 1000 barrels of hydrocarbon material. It will also be understood that the resulting fuel and lubricant compositions will contain other additive materials for their known purposes.

The reaction may also be optionally catalyzed with a rate accelerating catalyst such as, for example, n-butylamine, di-n-butylamine, n-octylamine, triethylamine, di-cyclohexylamine and the like. However, any suitable rate acceleration catalyst known in the art may be used, as for example quinoline and attapulgite acid clay.

In accordance with the invention the reaction between sulfur, hydrogen sulfide, water, an olefinic compound and a nitrogen-containing polymeric compound having at least one free amine group may be conducted in any suitable reaction vessel.

The compositions hereof may comprise any oleaginous materials utilized under conditions that require lubricative properties under extreme pressure conditions and require protection against excessive wear under operating conditions, and/or normally exhibit insufficient anti-corrosion properties. Especially suitable for use with the additives of this invention are liquid hydrocarbon oils of lubricating viscosity. Lubricant oils, improved in accordance with the present invention, may be of any suitable lubricating viscosity. In general, the lubricant compositions may comprise any mineral or synthetic oil of lubricating viscosity or mixtures thereof. The additives of this invention are especially useful in greases and in automotive fluids such as brake fluids and power brake fluids, transmission fluids, power steering fluids, various hydraulic fluids and gear oils and in liquid hydrocarbyl fuels.

In instances where synthetic oils are desired in preference to refined petroleum or mineral oil they may be employed alone or in combination with a mineral oil. They may also be used as the vehicle or base of grease compositions. Typical synthetic lubricants include polyisobutylene, polybutenes, hydrogenated polydecenes, polypropylene glycol, polyethylene glycol, trimethylol propane esters, neopentyl and pentaerythritol esters of carboxylic acids, di(2-ethylhexyl) sebacate, di(2-ethylhexyl) adipate, dibutyl phthalate, fluorocarbons, silicate esters, silanes, esters of phosphorus-containing acids, liquid ureas, ferrocene derivatives, hydrogenated mineral oils, chain-type polyphenols, siloxanes and silicones (polysiloxanes), alkyl-substituted diphenyl ethers typified by a butyl-substituted bis(p-phenoxy phenyl) ether, phenoxy phenylethers, dialkylbenzenes, etc.

As hereinbefore indicated, the aforementioned additives can be incorporated as additives in grease compositions. When high temperature stability is not a requirement of the finished grease, mineral oils having a viscosity of at least 40 SSU at 150° F. are useful. Otherwise those falling within the range of from about 60 SSU to about 6,000 SSU at 100° F. may be employed. The lubricating compositions of the improved greases of the present invention, containing the above-described additives, are combined with a grease forming quantity of a thickening agent. For this purpose, a wide variety of materials can be dispersed in the lubricating oil in grease-forming qualities in such degree as to impart to the resulting grease composition the desired consistency. Exemplary of the thickening agents that may be employed in the grease formulation are metal soaps as well as non-soap thickeners, such as surface-modified clays and silicas, aryl ureas, calcium complexes and similar materials. In general, grease thickeners are employed which do not melt or dissolve when used at the required temperature within a particular environment; however, in all other respects, any material which is normally employed for thickening or gelling oleaginous fluids or forming greases may be used in the present invention.

Generally the lubricants and fuels of the present invention contain an amount of the sulfurized product effective to improve extreme pressure properties and antiwear and oxidation characteristics. Normally this amount will be about 0.01–20%, preferably about 0.01–10%, of the total weight of the lubricant composition.

Other additives may be present for their known purposes in combination with the sulfurized olefinic product of the present invention. Such additives include, for example, detergents and dispersants of the ash-producing or ashless type, corrosion-inhibiting agents, auxiliary oxidation-inhibiting agents, pour point depression agents, auxiliary extreme pressure agents, color stabilizers and anti-foam agents.

These unique sulfurized olefins are preferentially prepared by the direct reaction of isobutylene, sulfur, hydrogen sulfide, water, and a nitrogen-containing substance, e.g., a succinimide at temperatures of from about 130° C. to about 200° C. for about 2 to about 24 or more hours at elevated pressure (about 300–900 psi) with agitation. As disclosed hereinabove, a rate accelerating catalyst may be optionally used.

From 0.001 to about 0.4 parts by weight of the amine-containing polymer per part of sulfur can be advantageously used. An optimal molar ratio of olefin to sulfur to hydrogen sulfide is about 1:0.5–2.0:0.2–1.0 although lower amounts of hydrogen sulfide can be used if desired. The olefin:sulfur ratio can vary from about 2:1 to about 1:2. The amount of water can vary from 1% to about 70 wt. % or more based on total amount of olefin, and preferably from about 2%–25 wt. %. After reaction is complete, the product can be vacuum topped, or nitrogen sparged and then filtered to yield a high sulfur, low nitrogen content composition.

The following examples serve to illustrate the present invention, but are not intended as a limitation thereon unless otherwise stated.

EXAMPLE 1

Approximately 408 g sulfur, 13 g of free amine-containing polyisobutenyl (900 MW)-succinimide (made using tetraethylene pentamine) 13 g water, 601 g isobutylene (approximately 1016 ml) and 142 g hydrogen sulfide were charged to a stainless steel reactor purged with nitrogen and equipped with a heater, provision for cooling and agitator. The reactants were heated at approximately 160°–165° C. until the pressure, which reached a maximum of approximately 690 psig during the early stages of the reaction, dropped to a low level and stopped dropping further indicating completion of reaction. Total reaction time was about 12 hours. The crude product was then sparged at about 100° C. with nitrogen for about 2 hours to remove small amounts of volatiles. The crude product was a brown, low viscosity fluid with low odor which was filtered through a 12½ cm. filter which had been precoated with a bed of diatomaceous earth. The product contained approximately 47.4% sulfur.

EXAMPLE 2

Approximately 408 g sulfur, 29 g of free-amine-containing polyisobutenyl (900 MW) succinimide (made using TEPA) 29 g water, 601 g isobutylene (approximately 1016 ml) and 142 g hydrogen sulfide were charged to a reactor as generally described in Example 1. The reactants were heated to approximately 160°–165° C. until the pressure, which reached a maximum of approximately 840 psig during the first hour of reaction, dropped to a low level and ceased dropping further, indicating completion of reaction. Total reaction time was approximately 12 hours. The crude product was then sparged at approximately 100° C. with nitrogen for approximately 2 hours to remove small amounts of volatiles. The crude product was a brown, low viscosity fluid with low odor which was filtered through a 12½ cm. filter which had been precoated with a bed of diatomaceous earth. The product contained approximately 46.9% sulfur and approximately 0.2% nitrogen.

EVALUATION OF PRODUCTS

The products of Examples 1 and 2 were blended into fully formulated automotive gear oil packages and evaluated for copper strip corrosivity as shown in Table 1. The examples in accordance with the invention are clearly superior to the comparative products.

TABLE 1

COPPER STRIP CORROSIVITY TEST BASED ON ASTM D 130-80

| | Concentration of Sulfurized Olefin in Fully Formulated Automotive Gear Oil Formulation, Wt. % | Corrosivity Rating |
|---|---|---|
| Example 1 | 3.0 | 1B |
| Example 2 | 3.0 | 1B |
| Comparative Examples (Product Produced by the Process of U.S. Pat. No. 3,703,504) | 3.4 | 2A |
| | 3.0 | 2B |

The products of Examples 1 and 2 were further blended into fully formulated automotive gear oil formulations containing inhibitors, antitrust and anticorrosion/antistaining additives and evaluated for EP/antiwear properties using the CRC-L-42 gear test and as shown in Table 2, the use of 3.0% of the products of Examples 1 and 2 passed the scoring test. Equivalent 3.0 percent concentrations and even higher concentrations of 3.2 and 3.4 percent of the Comparative Examples, product of U.S. Pat. No. 3,703,504 (sulfurized isobutylenes) failed the identical scoring test having as much as 30–35 percent scoring compared to Examples 1 and 2 which showed only about 3 percent scoring.

TABLE 2

CRC L-42 GEAR WEAR TEST

| | Concentration of Sulfurized Olefin in Fully Formulated Automotive Gear Oil Formulation, Wt. % | L-42 Rating |
|---|---|---|
| Example 2 | 3.0 | Pass (12% scoring) |
| Comparative Examples (Product Produced by the Process of U.S. Pat. No. 3,703,504) | 3.4 | Fail (15% scoring) |
| | 3.2 | Fail (20–25% scoring) |
| | 3.0 | Fail (30–35% scoring) |

The products of the examples were also evaluated for odor and were found to be significantly improved when compared to the product of Example 1 of U.S. Pat. No. 4,344,854, made in a manner analogous to the examples of this application but without the use of the above-described polymeric amine and the prescribed amounts of water as co-reactants.

Having thus generally described the invention and provided specific examplary disclosure in support thereof, it is to be understood that no undue restrictions are to be imposed by reason thereof except as defined by the following claims.

What is claimed is:

1. A multifunctional additive product having antiwear/extreme pressure, friction modifying and thermal or oxidative stability characteristics suitable for use in an oil of lubricating viscosity or grease thereof prepared in a process comprising reacting in a suitable reaction zone an olefinic-hydrocarbyl compound having at least one olefinic double bond with elemental sulfur, hydrogen sulfide, water and a polymeric succinimide having at least one free amine group.

2. The additive product of claim 1, wherein the reaction temperature varies from about 130 to about 200° C., the olefin to sulfur ratio varies from about 2:1 to about 1:2, the olefin to sulfur to hydrogen sulfide ratio may vary from about 1:0.5–2.0:0.2–1.0 and the water-to-olefin ratio may vary from about 0.1% to about 70 wt. % or more based on the weight of the olefin at a pressure of from about 300–900 psi.

3. The additive product of claim 1 wherein the process is a one step—one pot process.

4. The additive product of claim 1 wherein said process is carried out in the presence of a rate accelerating catalyst.

5. The additive product of claim 4 wherein said rate accelerating catalyst is selected from the group consisting of n-butylamine, di-n-butylamine, n-octylamine, triethylamine, diisopropylamine, cyclohexylamine, dicyclohexylamine, quinoline and attapulgite acid clay.

6. The additive product of claim 5 wherein the rate accelerating catalyst is n-butylamine.

7. The additive product of claim 1 wherein the olefinic compound is selected from the group consisting essentially of ethylene, propylene, 1-butene, cis and trans-2-butene, isobutylene, diisobutylene, triisobutylene, pentene, cyclopentene, hexene, cyclohexene, octene, 1-decene, butadiene, isoprene, divinyl benzene, pinene, p-menthene and limonene and mixtures thereof.

8. The additive product of claim 7 wherein the olefin is a $C_3$–$C_8$ olefin.

9. The additive product of claim 7 wherein the olefin is isobutylene.

10. The additive product of claim 1 wherein the succinimide polymer is the reaction product of a polyalkenyl succinic anhydride and tetraethylene pentamine.

11. The additive product of claim 10 wherein the succinimide polymer is the reaction product of a polyisobutenyl succinic anhydride and tetraethylene pentamine.

12. A process for making a multifunctional additive product having antiwear/extreme pressure, frictional modifying and thermal or oxidative stability characteristics suitable for use in oils of lubricating viscosity or greases prepared therefrom comprising reacting in a suitable reaction zone an olefinic hydrocarbyl compound having at least one olefinic double bond, elemental sulfur, hydrogen sulfide, water and a succinimide polymer having at least one free amine group.

13. The process in accordance with claim 12 wherein said process is a one step—one pot process.

14. The process in accordance with claim 12 wherein the pressure varies from about 300 to about 900 psi and the temperature varies from about 130° to 200° C. and the molar ratio of olefin to sulfur varies from about 2:1 to about 1:2; the molar ratio of olefin to sulfur to hydrogen sulfide varies from 1:05–2.0:0.2–1.0 and the wt. ratio of water to olefin varies from about 0.1% to about 70 wt. % or more based on the weight of the olefin at a pressure of from about 300 to 900 psi.

15. The process in accordance with claim 13 wherein said process is carried out in the presence of a rate accelerating catalyst.

16. The process in accordance with claim 15 wherein said rate accelerating catalyst is selected from the group consisting essentially of n-butylamine, di-n-butylamine, n-octylamine, triethylamine, diisopropylamine, cyclohexylamine, dicyclohexylamine, quinoline and attapulgite acid clay.

17. The process in accordance with claim 16 wherein the rate accelerating catalyst is n-butylamine.

18. The process in accordance with claim 15 wherein the olefin is selected from the group consisting essentially of ethylene, propylene, 1-butene, cis and trans-2-butene, isobutylene, diisobutylene, triisobutylene, pentene, cyclopentene, hexene, cyclohexene, octene, 1-decene, butadiene, isoprene, divinyl benzene, pinene, p-menthene and limonene.

19. The process in accordance with claim 18 wherein the olefin is isobutylene.

20. The process in accordance with claim 13 wherein the succinimide polymer has a molecular weight of from about 500 to 50,000.

21. The process in accordance with claim 13 wherein the succinimide polymer is the reaction product of a polyalkenyl succinic anhydride and tetraethylene pentamine.

22. The process in accordance with claim 21 wherein the succinimide polymer is the reaction product of a polybutenyl succinic anhydride and tetraethylene pentamine.

23. A lubricant composition comprising a major amount of an oil of lubricating viscosity or grease prepared therefrom and a minor amount sufficient to impart extreme pressure, antiwear activity, friction modifying and thermal and oxidative stability characteristics thereto of an additive product prepared in a process comprising reacting in a suitable reaction zone an olefinic hydrocarbyl compound having at least one olefinic double bond with elemental sulfur, hydrogen sulfide, water and a succinimide polymer having at least one free amine group.

24. The lubricant composition of claim 23 wherein in said process the pressure varies from about 300 to 900 psi and the temperature varies from about 130° to 200° C. and the molar ratio of olefin to sulfur varies from about 2:1 to about 1:2, olefin to sulfur to hydrogen sulfide ratio of from about 1:0.5–2.0:0.2–1.0 and a water-to-olefin ratio of from about 1% to about 50% or more based on the weight of the olefin at a pressure of from about 300–900 psi.

25. The lubricant composition of claim 23 wherein the reaction process is carried out in the presence of a rate accelerating catalyst.

26. The lubricant composition of claim 23 wherein said rate accelerating catalyst is selected from the group consisting of n-butylamine, di-n-butylamine, n-octylamine, triethylamine, diisopropylamine, cyclohexylamine, dicyclohexylamine, quinoline and attapulgite acid clay.

27. The lubricant composition of claim 26 wherein the rate accelerating catalyst is n-butylamine.

28. The lubricant composition of claim 23 wherein the olefin is selected from ethylene, propylene, 1-butene, cis and trans-2-butene, isobutylene, diisobutylene, triisobutylene, pentene, cyclopentene, hexene, cyclohexene, octene, 1-decene, butadiene, isoprene, divinyl benzene, pinene, p-menthene and limonene.

29. The lubricant composition of claim 28 wherein the olefin is isobutylene.

30. The lubricant composition of claim 28 wherein the succinimide polymer is the reaction product of a polyalkenyl succinic anhydride and tetraethylene pentamine.

31. The lubricant composition of claim 28 wherein the succinimide polymer is the reaction product of a polybutenyl succinic anhydride and tetraethylene pentamine.

32. The lubricant composition of claim 23 wherein said lubricant comprises a major amount of an oil of lubricating viscosity.

33. The lubricant composition of claim 32 wherein said oil is selected from mineral oils, synthetic oils or mixtures thereof.

34. The lubricant composition of claim 32, wherein said oil is a mineral oil or mixtures thereof.

35. The lubricant composition of claim 32 wherein said oil is a synthetic oil or mixture thereof.

36. The lubricant composition of claim 23 wherein said lubricant comprises a major amount of a grease.

37. The lubricant composition of claim 23 wherein said additive product varies from about 0.10 to about 20 wt. % of the total composition.

* * * * *

UNITED STATES PATENT AND TRADEMARK OFFICE

CERTIFICATE OF CORRECTION

PATENT NO. : 4,711,736

DATED : December 8, 1987

INVENTOR(S) : Andrew G. Horodysky & Derek A. Law

It is certified that error appears in the above-identified patent and that said Letters Patent is hereby corrected as shown below:

Col. 1 Entire - "Cross-Reference to Related Applications" left out of printed patent.

Col. 1, line 41 - "U.S. Patent No. 2,337,473" should be -- U.S. Patent No. 2,337,478--

Col. 3, line 66 - "hydroxyethylethylene" should be --hydroxyethyl-ethylene--

Col. 7, line 23 - "antitrust" should be --antirust--

Signed and Sealed this

Seventh Day of June, 1988

*Attest:*

*Attesting Officer*

DONALD J. QUIGG

*Commissioner of Patents and Trademarks*